US006411720B1

(12) United States Patent
Pritchard

(10) Patent No.: US 6,411,720 B1
(45) Date of Patent: Jun. 25, 2002

(54) SPEAKER SYSTEMS WITH LOWER FREQUENCY OF RESONANCE

(76) Inventor: Eric K. Pritchard, Rte. 1 Box 536, Berkeley Springs, WV (US) 25411

( * ) Notice: Subject to any disclaimer, the term of this patent is extended or adjusted under 35 U.S.C. 154(b) by 0 days.

(21) Appl. No.: 09/035,438

(22) Filed: Mar. 5, 1998

(51) Int. Cl.[7] ..... H04R 25/00

(52) U.S. Cl. ..... 381/348; 181/156; 381/345; 381/338; 381/351; 381/349

(58) Field of Search ..... 381/337, 338, 381/345, 346, 349, 351, 352, 401, 402, 406, 412, 339; 181/156

(56) References Cited

U.S. PATENT DOCUMENTS 1,977,469 A * 10/1934 Bussard
3,727,719 A * 4/1973 Yando
3,923,123 A * 12/1975 Latimer-sayer
4,336,861 A * 6/1982 Peter
4,593,784 A * 6/1986 Flanders
4,628,528 A * 12/1986 Bose
4,718,098 A * 1/1988 Ashworth
4,942,939 A * 7/1990 Harrison
5,105,905 A * 4/1992 Rice
5,177,329 A * 1/1993 Klayman
5,621,804 A * 4/1997 Beppu
5,781,642 A * 7/1998 Tanaka

* cited by examiner

*Primary Examiner*—Curtis Kuntz
*Assistant Examiner*—Dionne N. Harvey

(57) ABSTRACT

Speaker systems with lower frequency of resonance have a short air passage in a cabient from the speakers or drivers to an air passage exit. Teh resulting column of air lowers the resonant frequency or the drivers from within a frequency range of interest to below the frequency range. With the resonance out of the way, the resulting system is smaller and smoother.

31 Claims, 5 Drawing Sheets

SPEAKER SYSTEMS WITH LOWER FREQUENCY OF RESONANCE

BACKGROUND

This invention relates to loudspeaker systems for producing bass frequencies and more specifically relate to ported speaker systems. This invention falls between open-back cabinets, the Theile-Small aligned ported reflex cabinets, and the transmission line cabinets.

Loudspeaker systems consist of one or more drivers, once known as speakers, in a cabinet. Beginning with A. L. Thuras' "Sound Translating Device" patent in 1930, audio and acoustic engineers have been improving the capabilities of the loudspeaker system with improvements to the speaker cabinet, particularly the vented speaker cabinet. The most notable of these are P. W. Klipsch, R. Ashley, A. N. Thiele, J. E. Benson, R. Small, H. F. Olsen, L. L. Beranek, and R. M. Bullock. These men have studied and refined the original Thuras concept so that highly engineered speaker systems with flat frequency responses can be synthesized easily.

The loudspeaker synthesis design rules are quite strict and depend heavily on an amplifier that has a low output impedance or is highly damped and a speaker (driver) with a low Q and little resonance. Unfortuantely these conditions do not apply to musical instrument amplifiers or speakers. Highly damped amplifiers produce their low output impedance with a significant amount of feedback. While this feedback reduces the output impedance and reduces harmonic distortion, it also tries to overcome power supply limitations. Consequently, the response to being overdriven is substantial, rapidly rising, and high-order harmonics that produce unpleasant listening. Conversely, the present invention works with amplifiers designed to be overdriven. They have little feedback, and consequently, low damping factors. Musical instrument speaker (driver) design values efficiency over low Q and consequently do not have a Q factor as low as the modern high-fidelity drivers.

The transmission line cabinets load the driver, usually the back of the driver, with an acoustic transmission line which is a quarter wave length at the driver's resonant frequency. L. J. S. Bradbury applied wave theory to earlier observations that fibrous material slowed the speed of sound. Thus, a fiber filled tube could be a shorter, smaller acoustic transmission line. Unfortunately, these lines fail to provide enough damping for the high Q speakers common to the guitar and musical instrument arts.

The Klipsch loudspeaker systems enclose one side of the driver and load the other with a folded horn. This system is not applicable because the folded horn restricts the middle and upper frequency response. Further, according to the *Radiotron Designer's Handbook,* edited by F. Langford-Smith, 1957, pages 857 and 858, the volumes of Klipsch systems at about 5,000 cubic inches per driver are larger than the embodiments below.

The functional object of this invention, having the system resonance below the range of interest, is often accomplished with a free-air driver resonance already below the range of interest.

THE OBJECTS OF THIS INVENTION

The object of this invention is a speaker system having a driver or drivers in a smaller than prior art cabinet, said cabinet having an air passage, without fiber fill, although might have fiber lining, with a cross-sectional area approximately equal, ranging from ½ to 3/2, to the total active area of said driver or drivers, wherein the front sound waves of said drivers exit immediately to the exterior of the cabinet, and wherein said passage receives the rear sound waves of said driver, transmits them to the exterior of the cabinet, and loads the driver or drivers with an acoustic mass that reduces the frequency of driver resonance by more than 20 percent.

To object of this invention is a speaker system having drivers with free-air resonance within the frequency range of interest for said speaker system and having an air passge which loads said drivers to reduce the resonance below the range of interest.

The object of this invention is a speaker system similar to a transmission line type, ie. with approximate constant cross-sectional area per driver, but with a shorter path from the driver or speaker to the exit.

Another object of this invention is a shelter for an electro-mechanical spring reverberation device which partly defines the air passage.

Another object of this invention is a cabinet and speaker combination for a musical instrument which reduces the speaker resonant frequency so that it is below the frequency range of said musical instrument.

THE PRIOR ART

Figure 1:
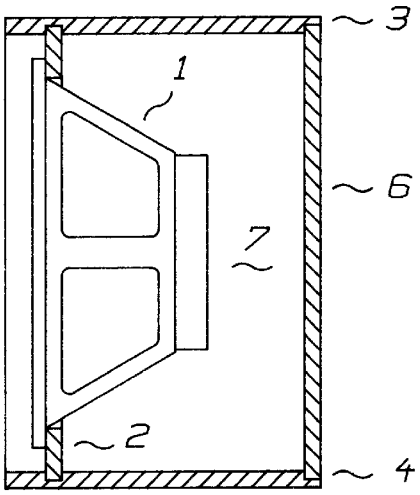
PRIOR ART FIGURE 1
FIGS. 1–4 are cross-sectional views of the prior art.

The prior art is illustrated by FIGS. 1 through 4. FIG. 1 is a closed back cabinet characterized by the resonant frequency of speaker 1 being raised by the air trapped between the speaker mounting board or front 2, the back 6, the top 3, the bottom 4, and the sides 7. This air acts as an acoustic spring and is in parallel with the cone suspension springs. The net spring action is stiffer and consequently raises the resonant frequency of the speake or driver 1 and makes resonance more severe. The resulting resonant frequency for guitar speakers is about 120 Hz and within the frequency range of guitars, a little more than a half octave above a low E note.

Figure 2:
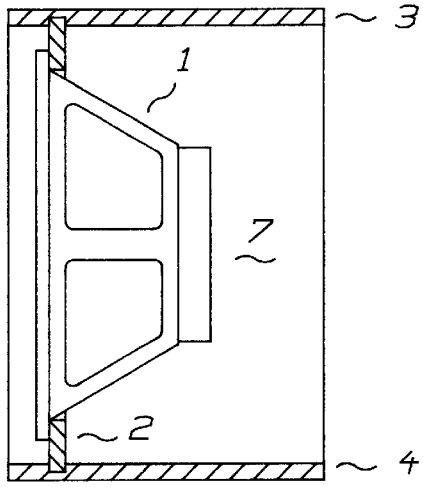
PRIOR ART FIGURE 2

FIG. 2 is an open back cabinet characterized by the resonant frequency of the speaker 1 being lowered slightly, usually five percent or less, but on occasion approach twenty percent. This cabinet is similar to the cabinet of FIG. 1 except there is no back 6 or essentially no back. The resonance is lowered slightly because the air behind the speaker acts as an acoustic mass. However, the cabinet is typically quite shallow, tall, and wide (as recommended by H. F. Olsen in *Acoustic Engineering,* D. Van Nostrand Co., 1957) and does not act as a large acoustic mass. The open back cabinet rolls off the bass by the cancellation of the front wave by the back wave.

Although not shown in FIG. 2, the open-back combined amplifier and speaker, or combo, has the amplifier mounted inside of the cabient. This design subjects the electronics to air induced vibrations.

Figure 3:
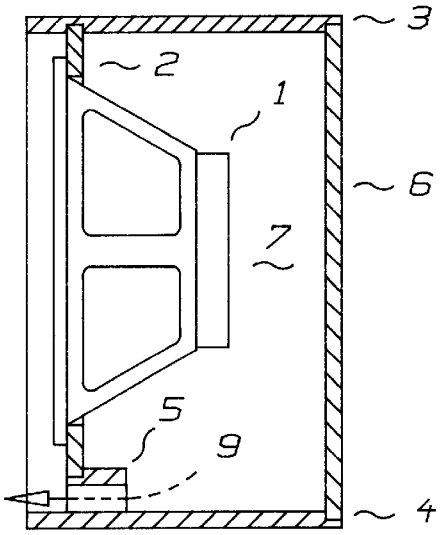
PRIOR ART FIGURE 3

FIG. 3 is a ported closed back cabinet having speaker 1, speaker mounting board or front 2, top 3, bottom 4, back 6, sides 7, and port 5. Air travels from inside the cabinet through the port 5 along path 9. The air in the cabinet is an acoustic spring and the air in the port is an acoustic mass. The two form a spring-mass system which, if properly designed and executed damps the resonance of the speaker 1 and creates a very flat frequency response throughout the bass region. This system is characterized by a cabinet resonant frequency and bandwidth is aligned to the speaker resonant frequency and bandwidth. This sytem is further characterized by a driver impedance curve that has two approximately equally high peaks separated by a valley. The ratio of the peak frequencies, according to *Radiotron Designer's Handbook,* should be less than 2.40.

Very resonant speakers with narrow bandwidths and high amplitudes, such as guitar speakers, are not recommended for this technology. Amplifiers with low damping factors, such as guitar amplifiers are also not applicable to this technology as the Theile-Small alignments produce impractically large cabinets.

Notice that the cross sectional area of the passage from said driver 1 to said port 5 is not constant nor even approximately constant.

Figure 4:
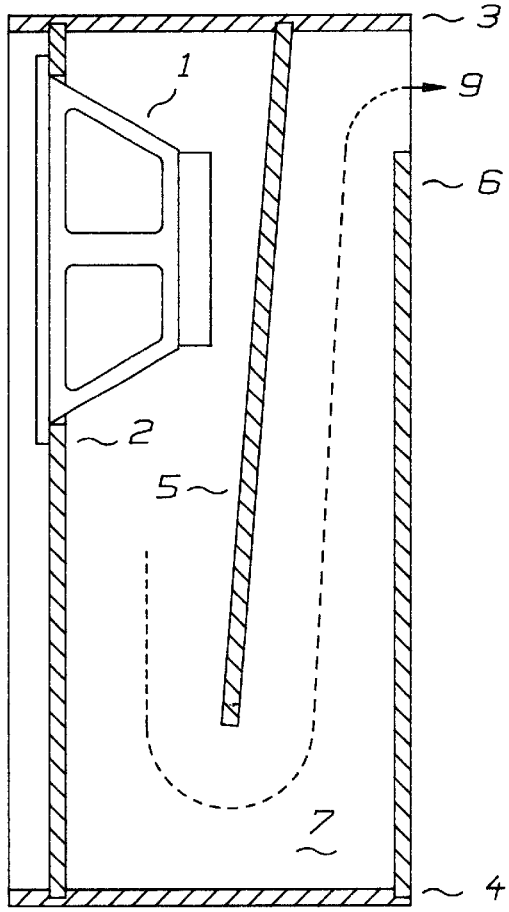
PRIOR ART FIGURE 4

FIG. 4 is a transmission line or acoustical labyrinth cabinet. The speaker 1 is in a box having front or speaker mounting board 2, top 3, bottom 4, back 6, sides 7, and partition 5. The back 6 is partially open and partition 5 divides the cabinet to form a long, quarter wave air passage 9. Although path 9 may only go through air, transmission line cabinets are often filled with an acoustic fiber to reduce the speed of sound so that the physical length may be shorter. The air passing along path 9 reaches the exterior and there creates a reflection which passes back along path 9 to speaker 1. The reflection loads the speaker with a delayed signal. If the delay time is one-half the resonant period, ie. the path is a quarter-wavelength long, then the speaker resonance is reduced in amplitude if not canceled completely. However, this is not a strong effect and consequently requires speakers that are not only weakly resonant and amplifiers with high damping factors, the antithesis of guitar equipment.

The air transmission line cabinet is musically better than the fiber filled transmission line and the closed back or sealed cabinet, but it is not as good as the following embodiments.

THE FIRST EMBODIMENT

Figure 5:
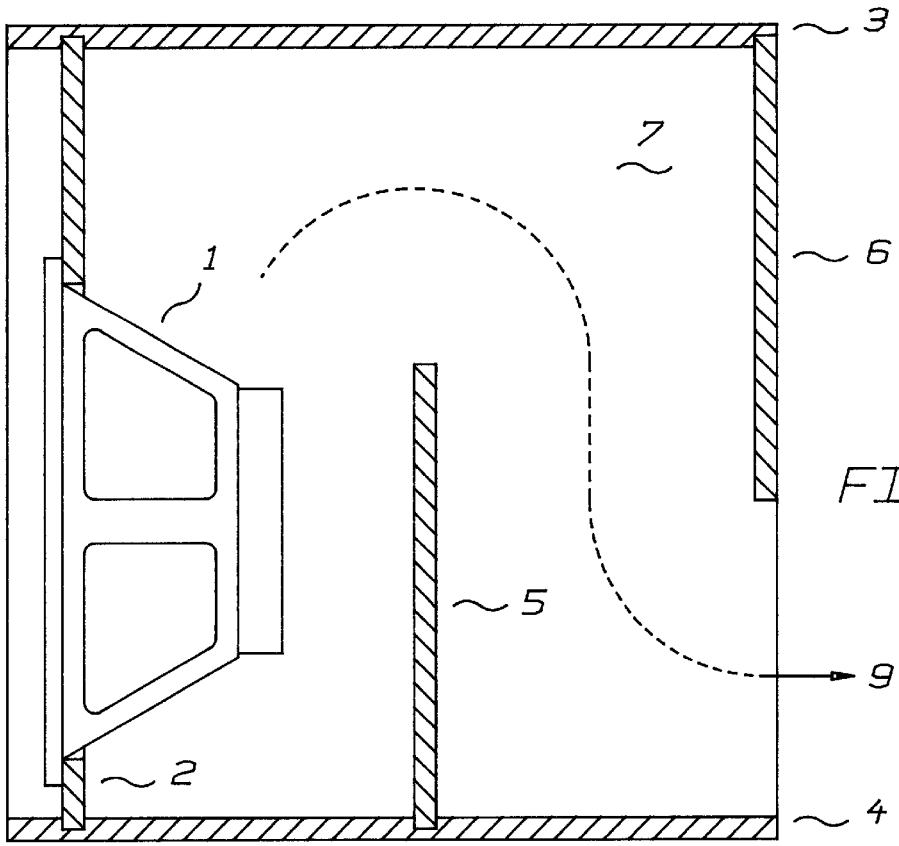
FIG. 5 is a side cross-sectional view of the preferred embodiment.

FIG. 5 is a side cross-sectional view of the first embodiment, a speaker cabinet for bass guitar. The 12-inch driver 1 is mounted in a cabinet having a speaker mounting board 2, top 3, bottom 4, partition 5, partial back 6, and sides 7. The sound waves from the front of the driver exit the cabinet immediately, through a grill which is not shown, while the rear sound waves travel along path 9 to the exterior of the cabinet. The air along path 9 from driver 1 to the exterior of the cabinet forms a formidable acoustic mass that lowers the frequency of resonance of the driver 1. The acoustic mass also lowers the amplitude of resonance and consequently makes the resonance weaker and less noticeable. In fact, the slight resonance gives the system some character not found in prior art loudspeaker systems.

For example, FIG. 5 was implemented with ½ inch plywood having interior dimensions of 13.5 inches deep, 18.5 inches high, and 25 inches wide (in-out of FIG. 5). The partition is centrally located. The partition and the back are cut to leave a gap of 6.5 inches. FIG. 5 was implemented with a pair of 12 inch bass speakers (the second was mounted behind driver 1) having a free air resonance of about 60 Hertz. Once installed in this embodiment the resonance dropped to about 35 Hertz.

The active area of the speakers is about 75 square inches each or about 150 square inches total. This is about the same as the air passage cross-sectional area of 6.5×25 inches of 162.5 square inches.

The smallest internal cabinet volume recommended in *Radiotron Designer's Handbook,* edited by F. Langford-Smith, 1957, pages 846 and 845, is 5500 cubic inches for a single driver, 11,000 cubic inches for two drivers. The driver volumes add 650 cubic inches each or 6,150 and 12,000 cubic inches respectively. The later is about twice as large as the 6,243 cubic inches of the present invention.

The preferred driver for this cabinet has a Q of 0.66 and a Vas of 2.75 cubic feet or 4,752 cubic inches. According to Robert M. Bullock III in *Bullock on Boxes* distributed by Old Colony Sound Lab, the smallest bos with a Theile-Small alignment for a pair of these drivers is over 18,000 cubic inches and that assumes a high damping factor amplifier which, of course, is not used.

The air filled transmission line cabinet for this pair of drivers requires a quarter-wave length air passage of 56.5 inches with a cross-sectional area of 150 square inches. With the driver volumes and space beyond the drivers included, the total cabinet volume is more than 10,000 cubic inches and is again larger than the present invention.

Although the transmission line theory indicates that the length of the passage could be reduced by filling the passage with fiber, the fiber attenuates the signals in the passage. This attenuation reduces the reflected signal and reduces the resonance cancellation and thereby makes the fiber-fill unworkable for highly resonant drivers.

THE SECOND EMBODIMENT

Figure 6:
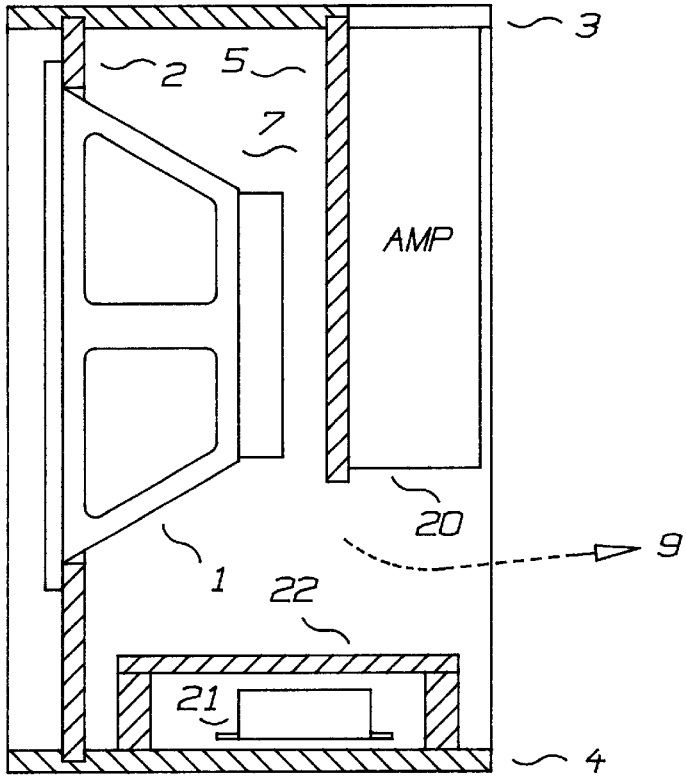
FIG. 6 is a side cross-sectional view of a second embodiment which includes an amplifier, reverberation unit, and shelter means.

FIG. 6 is the side cross-sectional view of the second embodiment, a combination of speaker or driver and amplifier in a cabinet. The 12-inch driver 1 is mounted in a cabinet having speaker mounting board 2, top 3, bottom 4, partition and amplifier mount 5, and sides 7. The amplifier 20 is mounted with the knobs up on the partition 5 on the side opposite the driver. The electro-mechanical spring reverberation unit 21 is mounted to the bottom 4 inside a sheltering cover 22. The sound waves from the front of the driver exit the cabinet immediately, through a grill which is not shown, while the rear sound waves travel along path 9 to the exterior of the cabinet. Again, the air around path 9 is an air mass that lowers the frequency of resonance of driver 1. Cover 22 not only shelters the spring reverberation unit 21 from the air waves from the rear of the speaker 1, it helps define a portion of the air passage along path 9 by providing a boundary.

FIG. 6 was implemented in two ways, as a single 12 and a twin 12, by way of example. The single 12 cabinet has an internal measurement of 5 inches between the speaker mounting board 2 and partition 5. The distance between the top and bottom is 14 inches and the distance between the sides is 16 inches. The height of the cover 22 is about 2 inches. The air passage cross-sectional area in the region of the amplifier is about the active area of the cone of driver 1. The twin 12 is similar with 6 inches between the speaker board 2 and partition 5, 17 inches between top and bottom and 25 inches between the sides.

The smallest internal cabinet volume recommended in *Radiotron Designer's Handbook,* edited by F. Langford-Smith, 1957, pages 846 and 845, including the driver volume is 4,000 cubic inches for a single driver with a resonant frequency of 85 Hertz, 8,000 cubic inches for two drivers. Again, these volumes are substantially larger than the approximate 1,160 cubic inches of the first example of this second embodiment, and 2,700 cubic inches of the second.

The preferred driver for this cabinet has a Q of 0.92 which is beyond the range of the Theile-Small alignment tables provided by Robert M. Bullock III in *Bullock on Boxes.* Although one can find alignments for such drivers, they produce very large, impractical cabinets.

The transmission line cabinet for this driver must have an air passage length of about 40 inches. With cross sectional areas of 75 and 150 square inches respectively, the cabinet volumes, including space beyond the drivers would exceed 4,000 and 8,000 cubic inches respectively, again about double the volumes of the present invention.

In both versions of the second embodiment, the resonant frequency of the driver or drivers were reduced in both frequency and amplitude. The installed resonant frequency is about 60 Hertz, down about 30% from the nominal 86 Hertz free air resonance. The lower installed resonant frequency and the entire resonant bandwidth is lower in frequency than the lowest note in a guitar. It is lower than the frequency range of interest, the frequency range of the guitar. Without a resonant peak in the operating frequency range, the guitar and amplifier sounds smoother.

The reverberation shelter not only shields the spring reverberation unit from air waves created by the speaker or driver, it shields the spring reverberation unit from sight. The location of the amplifier 20 also shields a substantial portion of the drivers from sight. The result is a combination amplifier and speaker which is substantially more attractive than other designs.

THE THIRD EMBODIMENT

Figure 7:
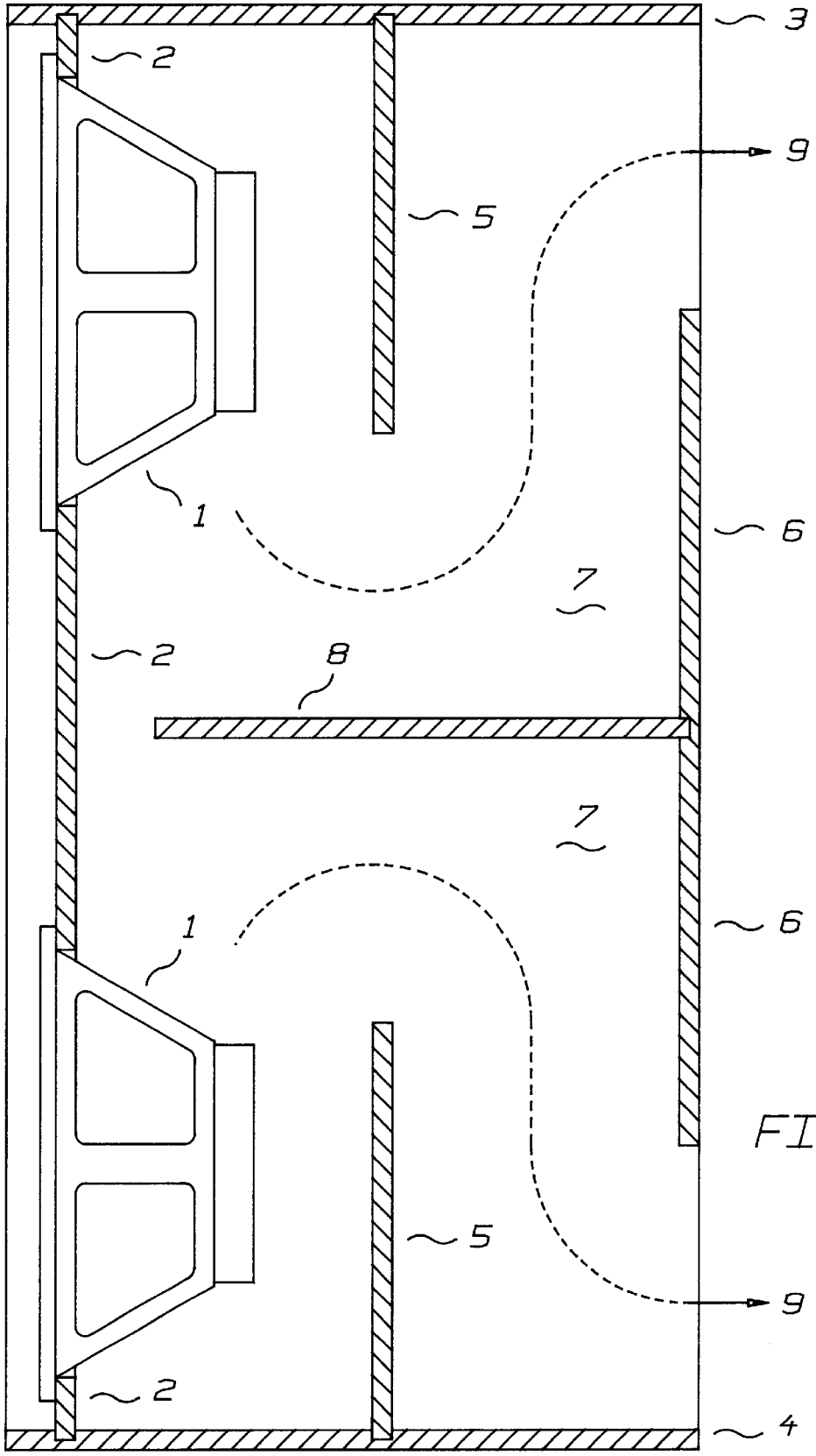
FIGS. 7 and 8 are side cross-sectional views of third and fourth embodiments having multiple drivers.

FIG. 7 is the side cross-sectional view of the third embodiment, which has four 12-inch drivers, the two shown and two more behind those two. The drivers 1 are mounted in a cabinet having speaker mounting board 2, top 3, bottom 4, partitions 5, partial back 6, sides 7, and section partition 8. The sound waves from the front of the driver exit the cabinet immediately, through a grill which is not shown, while the rear sound waves travel along path 9 to the exterior of the cabinet. Again, the air around paths 9 is an air mass that lowers the frequency of resonance of drivers 1.

For example, the internal dimensions are similar to the embodiment of FIG. 5. The partitions 5 are mounted halfway between the speaker mounting board 2 and back 6 which are separated by 13.5 inches. The partition 8 is mounted halfway between top 3 and bottom 4 which are separated by about 29 inches. The sides are separated by about 25 inches. The partition 8 may also support the speaker mouting board 2.

The smallest internal cabinet volume recommended in *Radiotron Designer's Handbook,* edited by F. Langford-Smith, 1957, pages 846 and 845, including the driver volume is 4,000 cubic inches for a single driver with a resonant frequency of 85 Hertz, 16,000 cubic inches for four drivers. Again, this is substantially larger than the approximate 9,800 cubic inches of the third embodiment.

Since the preferred driver for this cabinet is the same driver used in the second embodiment, there is no recommended Theile-Small alignment since the cabinet would be impractically large.

Like the second embodiment, this embodiment also reduced the resonant frequency to about 60 Hertz which is below the range of interest, the range of the musical instrument for which it is intended, a guitar.

THE FOURTH EMBODIMENT

Figure 8:
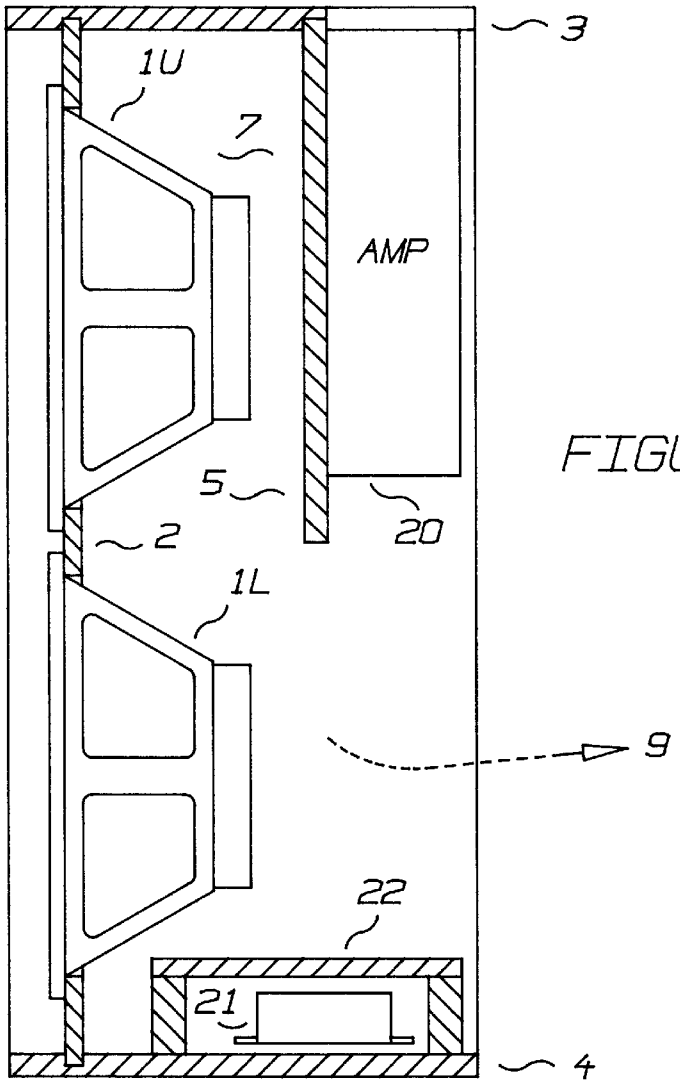

FIG. 8 is the side cross-sectional view of the fourth embodiment, which like FIG. 7, includes four 10-inch drivers, two as shown and two more behind those two, thus mounted in two rows of two. The upper row has two speakers 1U and the lower row also has two speakers 1L. The driver pairs 1U and 1L are mounted in a cabinet having speaker mounting board 2, top 3, bottom 4, partition 5, and sides 7. Amplifier 20 is mounted on partition or back 5 on the side opposite of the drivers. The sound waves from the front of the driver exit the cabinet immediately, through a grill which is not shown, while the rear sound waves travel along path 9 to the exterior of the cabinet. Again, the air around path 9 is an air mass that lowers the frequency of resonance of drivers 1.

The top 3 and bottom 4 are separated by about 23 inches and the sides are separated by about 21 inches. The speaker mounting board 2 and back 5 are separated by 5 inches. This produces a cross-sectional area of 105 square inches in the region, the first region, of the upper row drivers 1U. This is approximately equal to the total active area of the two upper row drivers which are 50 square inches each. In the region of the lower row drivers 1L, the cross-sectional area must increase to approximately 200 square inches, hence the approximate 10 inch distance between the lower end of the partition 5 and the spring reverberation means shelter 22.

The change in cross-sectional area of the air passage to accomodate additional drivers is not found in bass reflex cabinets or horns. Bass reflex cabinets collect all of the sound waves from the drivers in a chamber and then pass those waves through a much smaller vent. The horn places a plurality of drivers in a plane perpendicular to the axis of the horn so that they act as a single, large driver.

The free air speaker resonance of the drivers is 95 Hertz and within the frequency range of guitars. Once these drivers are mounted in the cabinet the lower resonance drops to 65 Hertz and the upper resonance, beyond 2.4 times the lower resonant frequency of 65 Hertz, virtually does not exist. The 65 Hertz installed resonance is below the frequency range of a guitar, the frequency range of interest in this case.

THE FIFTH EMBODIMENT

Figure 9:
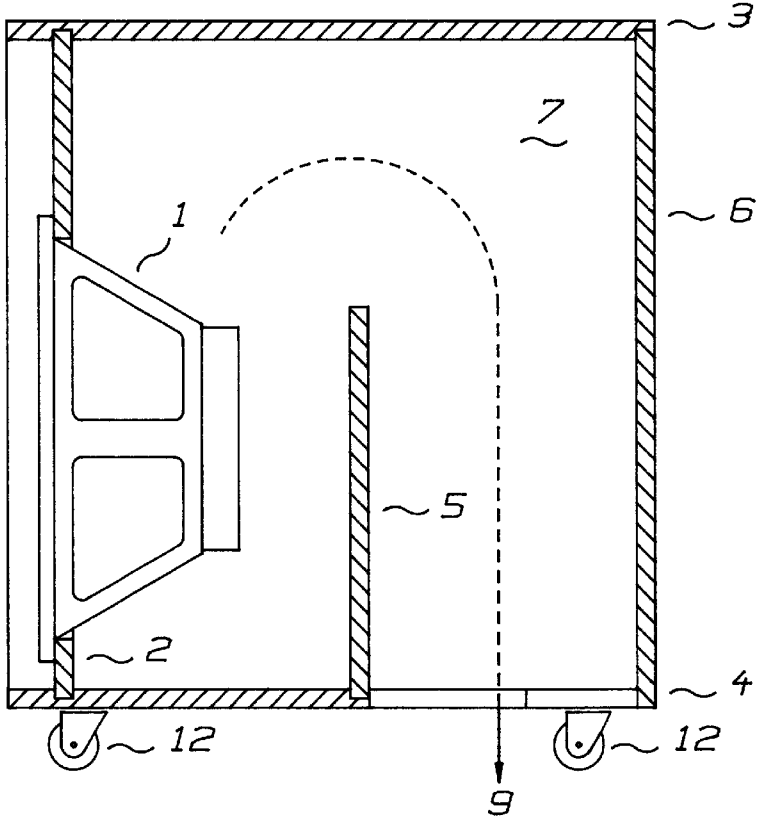
FIG. 9 is a side cross-sectional view of a fifth embodiment having bottom air passage exit.

FIG. 9 is the side cross-sectional view of the fourth embodiment. The 18-inch driver 1 is mounted in a cabinet having speaker mounting board 2, top 3, bottom 4, partition 5, back 6, sides 7, and casters 12. The sound waves from the front of the driver exit the cabinet immediately, through a grill which is not shown, while the rear sound waves travel along path 9 to the exterior of the cabinet through a hole in the bottom. Again, the air around path 9 is an air mass that lower the frequency of resonance of driver 1.

For example, the partitions 5 are mounted halfway between the speaker mounting board 2 and back 6 which are separated by 17.5 inches. The top 3 and bottom 4 and the sides are separated by about 25 inches.

The smallest internal cabinet volume recommended in *Radiotron Designer's Handbook,* edited by F. Langford-Smith, 1957, pages 846 and 845, including the driver volume is over 30,000 cubic inches for a single driver with a resonant frequency of 30 Hertz. Again, this is substantially larger than the approximate 10,937 cubic inches of the fourth embodiment.

The preferred driver for this cabinet has a Q of 0.32 and a Vas of 19 cubic feet. Assuming a high damping factor amplifier, the Theile-Small aligned cabinet has a volume of about 17,000 cubic inches, much larger than the fourth embodiment. However, most musicians do not prefer such amplifiers as they are generally cold, sterile, and stiff.

This embodiment also reduced the resonant frequency from 27 Hertz to about 20 Hertz which is below the range of the musical instrument for which it is intended, a bass guitar with a low B string (about 28.5 Hertz). Although the resonant frequency is slightly below the range of the guitar, the resonance still affects the range of the guitar significantly since the Q of the speaker is substantially lower than 20. However, reducing the resonant frequency to 20 Hertz substantially removes the resonant character from the frequency range of the bass guitar.

A DESIGN RULE

The "rule of thumb" for the design of the present invention is simple. First, make the air passage from the exit to the driver approximately 1000 inches/sec divided by the free air resonant frequency of the driver. The air passage length can be longer for greater loading and resonant frequency reduction, however, the line should be less than a quarter-wave length since the transmission line cabinet is not as effective. Preferably the air passage length is between 1/16 and 1/8 wavelength of the resonant frequency. Certainly, the ubiquitous demands for small physical size make this an easy requirement. Second, make the air passage cross-section approximately equal to the active area of the driver or the total active area of the drivers and may vary from 1/2 to 3/2 of this area. While this may not be possible in the region of the driver because of the size of the drivers, that area should be reduced by approximately the active area of the drivers.

More simply put, this invention is similar to a fiber filled transmission line cabinet calculated for about 1 pound of fiber per cubic foot, but without filling the air passages with fiber.

The driver impedance curve for the present invention is similar to the vented cabinet dual peak except that the higher peak is substantially higher and much weaker. The ratio of the peak frequencies is greater than 2.40, the recommended maximum for bass reflex vented cabinets. The amplitudes of the higher peak is far lower than the amplitude of the lower peak, often the higher peak is only about 10 percent higher than the valley impedance. In some cases the upper peak disappears completely.

Empirically, the more musically pleasing cabinets have a small higher peak or no higher peak at all. The amplitude and frequency ratio of the higher peak has been correlated to the dead space around the driver which is not in path 9. The air in this dead space acts as a spring as compared to the air between the driver and the port which acts as a mass. Although one needs some dead space to clear the driver, too much is detrimental. This is quite unlike the standard ported cabinets which have substantial "dead space" volumes and very little port volumes.

The higher peak is found in the region between the bass resonant frequency, or the reduced resonant frequency, and the general rise in impedance due to the driver inductance.

Other Small Boxes

Small cabinets are part of teh prior art, *Radiotron Designer's Handbook,* page 849, however, the air passage cross-sectional area is substantially reduced and the resonances are still substantial and in the range of the instruments.

Constant Cross Section

The cross section of FIGS. 5, 6, 7, and 9 are approximately constant. They are approximately constant if one neglects the expanded area of the square cornered bends. The cross section of the air passage in FIG. 8 expands as it passes the second row of drivers. The transmission line cabinet has an approximately constant cross section, however, the air passage is one quarter wavelength which is longer than the air passages in these embodiments. These embodiments have air passages generally less than one eighth wavelength or less.

The Preferred Driver Embodiment

Figure 10:
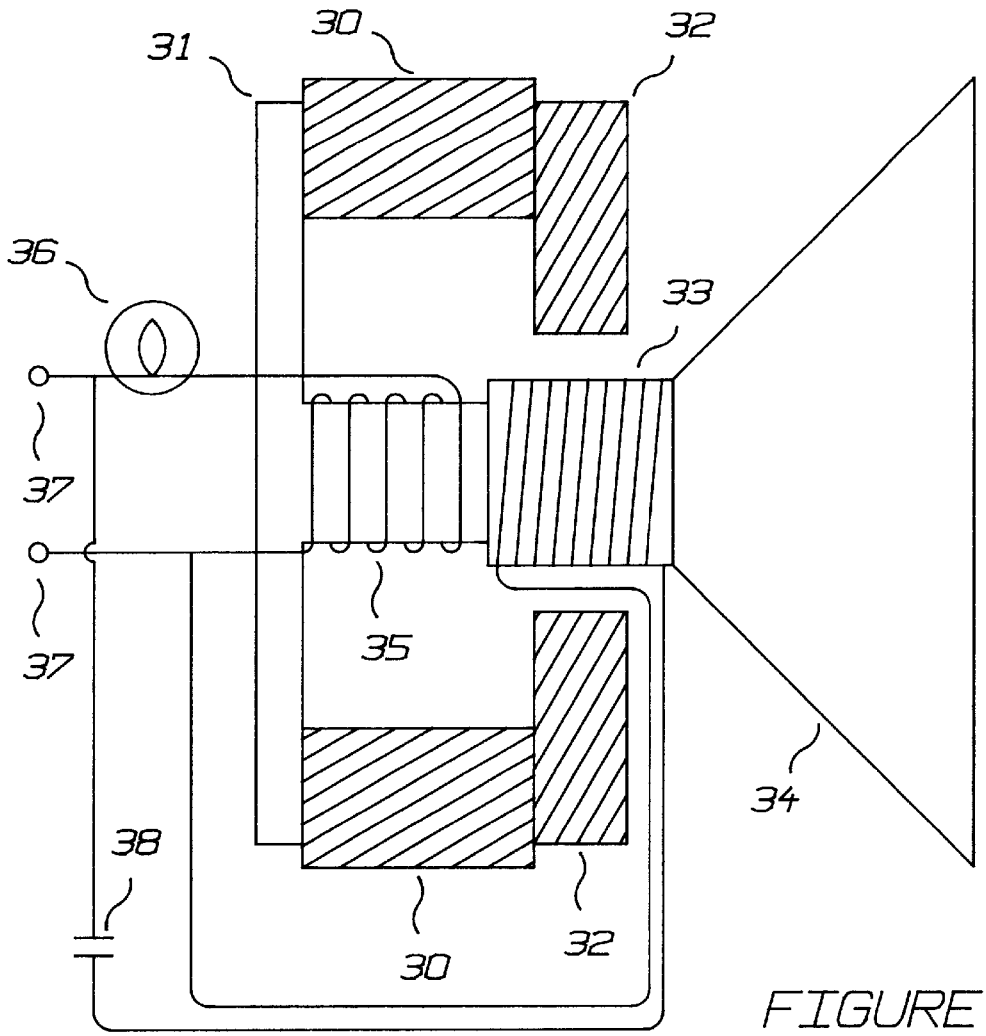
FIG. 10 is a cross-section of the preferred driver.

FIG. 10 is the preferred driver embodiment showing a permanent magnet 30 which produces a magnetic field that is conducted by an inner pole piece 31 and an outer pole piece 32 to the magnetic gap created for the voice coil 33. The voice coil drives the cone 34. For clarity the remaining standard speaker components, frame and cone suspension, are not shown but are required.

The improvement to this driver is the additional coil or the field coil 35 which is preferably wound on the inner pole piece 31. This coil can be wound to have a significant inductance and resistance and thereby forms a low-frequency low-pass filter having a cutoff above 50 Hertz, preferably about 300 Hertz, which may be augmented external components as well-known to the filter arts. Like the voice coil, this field coil is responsive to the input. It may be directly connected to the driver terminals 37 or connected via a lamp 36. Additional filtering may be added to either connection. The resistance characteristic of a properly sized lamp produces little attenuation at low input signal levels, but a substantial attenuation at high input signal levels to extend the range of the embellishment.

The embellishment is formed by the interaction of the signal in the voice coil with the signal in the field winding. While the usually expected output is formed by the non-linear, approximately multiplicative, interaction of the signal and the permanent magnet, the embellishments are formed by the same non-linear, approximately multiplicative, interaciton of the signal in the voice coil with the filtered signal in the field winding. The field coil can produce a signal in the output by inducing a current into the voice coil. However, this is not efficient and is comparatively less than driving the voice coil directly.

The power requirements of the present invention field coil are substantially lower since the field coil of the present invention has a D.C. resistance higher than the voice coil. Although high fidelity speakers may have low efficiencies, low efficiency is not universally acceptable and particularly not acceptable for guitar speakers. Such a high resistance precludes series resonance at very low frequencies as found in the prior art.

For clarity, FIG. 10 is not to scale. In reality, the magnet 30 is substantially thinner than shown and consequently minimizes the length of the field coil 35. Also, the ceramic magnets used today are thinner and the magnetic circuit is much shorter than the Alnico magnets used in the past because the ceramic magnet has a much higher coercive force. This makes the space available for the field coil much smaller. Further, as shown, the voice coil moves over the field coil and constrains its outer diameter. The inner diameter is also constrained by the desire to keep the reluctance of the magnetic field path low. Thus, the substantial field coil required by Lokkesmoe is not practical now.

The interaction of the voice coil with the permanent magnet produces the input signal. The interaction of the voice coil and the field coil produces intermodulation products. The field coil via other means produces comparatively less of the signal than the voice coil and the permanent magnet.

Additional Filtering

Electronic filtering to correct the frequency response of a speaker system is part of the audiophile ars. The present invention makes the use of electronic filtering more attractive because the Q factor of the driver is reduced by the present invention in two ways. First, the driver is loaded by an acoustic mass which lowers the resonant frequency and the Q factor. Second the preferred driver includes a second winding which loads the driving amplifier and reduces the voice coil driving impedance.

Figure 11:
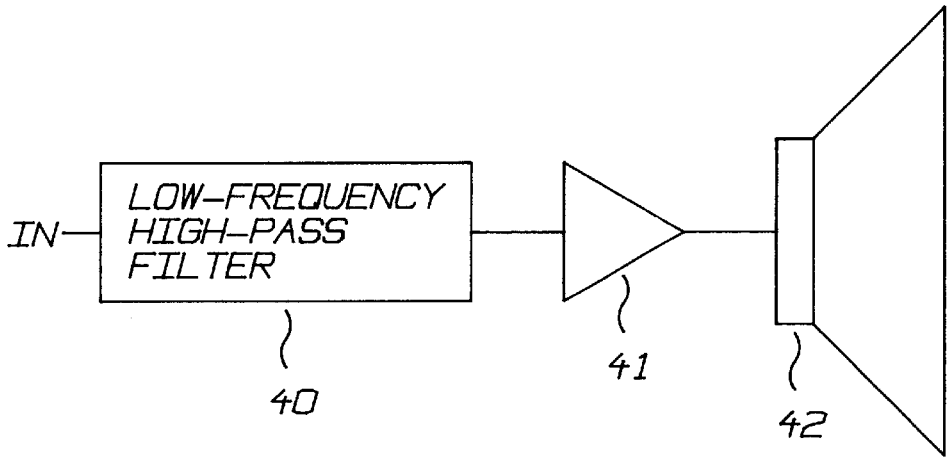
FIG. 11 is a block diagram of an amplifier/speaker system with an additional low-frequency high-pass filter.

FIG. 11 is a block diagram of a power amplifier 41 connected to a driver or drivers 42 which is mounted in one of the cabinets of FIGS. 5–9. The addition of low-frequency, high-pass filter 40 to the power amplifier 41 will flatten the response of the speaker system if the filter is designed correctly. Although one can do this by trial and error, following the alignment or design tables for common filters is better. Since the present invention reduces the Q factor of the driver, it is easier to find an alignment, particularly a low-order alignment.

Examples of electronic filters and alignment or tuning tables are provided in Chapter 8 titled "Active Filters" in *Operational Amplifiers—Design and Applications,* edited by Tobey, Graeme, and Huelsman, McGraw-Hill, 1971.

What is claimed is:

1. A speaker system for converting electrical signals into acoustic signals including:

a cabinet having a driver connected to said electrical signals for producing front and rear acoustic signals, said driver having a free-air low-frequency resonance that has a free-air low-frequency resonant frequency;

an air-filled passage contained within said cabinet for receiving said rear acoustic signals and for conducting said received acoustic signals to a passage exit at the exterior of said cabinet, wherein said air-filled passage extends from said driver to said exit and is shorter than one-eighth of the wavelength of said free-air low-frequency resonant frequency of said driver in air, and wherein said air-filled passage loads said driver and thereby produces a driver resonant frequency less than said free-air low-frequency resonant frequency by more than 20 percent.

2. The speaker system of claim 1 wherein said driver has input terminals connected to said electrical signals, a voice coil connected to said input terminals and a permanent magnetic structure having a permanent magnet operable over the operating range of said driver including:

a field winding means connected to said input terminals mechanically separate from said voice coil for altering the magnetic field of said permanent magnetic structure, said field winding being part of or forming a rectifier-less filter having a minus 3 db high frequency roll off greater than 50 Hertz; so that the sound from said driver includes components from the interaction said voice coil and said permanent magnet and the intermodulation distortion components from the interaction of the voice coil and said field winding as energized by said signal means; wherein the sounds produced by said field coil are comparatively less than the sounds produced by said voice coil.

3. The speaker system of claim 1 including amplifier means for driving said drive and filter means connected to series with said amplifier means and said driver wherein said filter means attenuates signals to the driver at and near the resonant frequency of said driver more than a higher frequency signal.

4. The speaker system of claim 1 incluing amplifier means for providing said electrical signals mounted to the exterior of said air passage.

5. The speaker system of claim 1 including sheltering means for sheltering a spring reverberation means and for providing a boundary for said air-filled passage.

6. The speaker system of claim 1 wherein said driver resonant frequency is more than 30 percent less than said free-air low-frequency resonant frequency.

7. The speaker system of claim 1 which includes an amplifier to amplify a musical instrument having a frequency range, wherein said amplifier is connected to said drivers, and wherein said produced driver resonant frequency is below said frequency range of said musical instrument.

8. The speaker system of claim 1 wherein said air-filled passage, neglecting the expanded area of any bends in said air passage, is approximately constant.

9. The speaker system of claim 1 wherein a wall of said air-filled passage is a partition between two portions of said passage.

10. A speaker system including one or more drivers for producing acoustic signals, said drivers having a free-air low-frequency resonance that has a free-air low-frequency resonant frequency;

a cabinet for mounting said driver or drivers and containing an air-filled air passage from a driver to an air passage exit at the exterior of the cabinet;

wherein the cross sectional area of said passage at any driver location is between ½ and 3/2 of the total active area of said driver of drivers from the beginning of said passage to said driver location and the cross sectional area at said exit is between ½ and 3/2 of the total active area of said driver or all of said drivers;

wherein said air passage length is less than ⅛ wavelength in air of said low-frequency resonant frequency; and wherein said air passage loads said driver or drivers to reduce the driver resonant frequency from said free-air resonant frequency by 20 percent or more.

11. The speaker system of claim 10 including an amplifier for operating said driver or drivers and that is mounted to the exterior of said air passage.

12. The speaker system of claim 10 wherein at least one of said drivers has input terminals, a voice coil and a permanent magnetic structure having a permanent magnet operable over the operating range of said speaker including:

a field winding means connected to said input terminals mechanically separate from said voice coil for altering the magnetic field of said permanent magnetic structure, said field winding being part of or forming a rectifier-less filter having a minus 3 db high frequency roll off greater than 50 Hertz; so that the sound from said driver includes components from the interaction said voice coil and said permanent magnet and the intermodulation distortion components from the interaction of the voice coil and said field winding as energized by said signal means; wherein the sounds produced by said field coil are comparatively less than the sounds produced by said voice coil.

13. The speaker system of claim 10 including sheltering means for sheltering a spring reverberation means and for providing a boundary for said passage.

14. The speaker system of claim 10 with a single 18 inch driver wherein said cabinet includes a driver mounting board for mounting said driver, sides, top, bottom, back, and partition;

said partition is positioned and dimensioned to create a long air passage;

the distance between the driver mounting board and the partition is 6 to 10 inches; the distance between the partition and the back is 6 to 10 inches; the distance between the sides is 18 to 30 inches; and the driver mounting board is 18 to 30 inches wide by 18 to 36 inches high.

15. The speaker system of claim 11 with a single 12 inch driver wherein said cabinet includes a driver mounting board for mounting said driver, sides, top, bottom, and back;

the distance between the driver mounting board and the back is 5 to 7 inches; the distance between the sides is 12 to 24 inches; and the driver mounting board is 12 to 24 inches wide by 12 to 20 inches high;

said back is partial to provide an exit for said air passage.

16. The speaker system of claim 10 with two 12 inch drivers wherein said cabinet includes a driver mounting board for mounting said drivers, sides, top, bottom, and back;

the distance between the driver mounting board and the back is 5 to 7 inches; the distance between the sides is 24 to 30 inches; and the driver mounting board is 24 to 30 inches wide by 12 to 20 inches high;

said back is partial to provide an exit for said air passage.

17. The speaker system of claim 11 with two 12 inch drivers wherein said cabinet includes a driver mounting board for mounting said drivers, sides, top, bottom, and back;

the distance between the driver mounting board and the back is 5 to 7 inches; the distance between the sides is 24 to 30 inches; and the driver mounting board is 24 to 30 inches wide by 12 to 20 inches high;

said back is partial to provide an exit for said air passage.

18. The speaker system of claim 11 with two 10 inch drivers wherein said cabinet includes a driver mounting board for mounting said drivers, sides, top, bottom, and back;

the distance between the driver mounting board and the back is 4 to 6 inches; the distance between the sides is 20 to 30 inches; and the driver mounting board is 20 to 30 inches wide by 10 to 20 inches high;

said back is partial to provide an exit for said air passage.

19. The speaker system of claim 10 with four 12 inch drivers wherein said cabinet includes a driver mounting board for mounting said drivers, sides, top, bottom, back, partitions, and section partition;

said drivers are mounted in two rows of two on said driver mounting board which is 24 to 30 inches by 24 to 36 inches;

said cabinet is divided into two approximately equal parts by said section partition;

said back is partial and provides exits for air passages from said drivers wherein the total area of said exits is between 150 and 450 square inches;

said partitions partially divide said sections to create a longer air passage path from said drivers to said air passage exits; and the distance between said driver mounting board to said partition is 5 to 8 inches and the distance between said partition and said back is 5 to 8 inches.

20. The speaker system of claim 10 with four 10 inch drivers wherein said cabinet includes a driver mounting board for mounting said drivers, sides, top, bottom, and back;

said drivers are mounted in two rows of two on said driver mounting board which is 20 to 30 inches by 20 to 30 inches;

said back is partial and provides an exit for the air passage from said drivers wherein the area of said exit is between 100 and 300 square inches;

the distance between said driver mounting board to said back is 4 to 7 inches.

21. The speaker system of claim 11 with four 10 inch drivers wherein said cabinet includes a driver mounting board for mounting said drivers, sides, top, bottom, and back;

said drivers are mounted in two rows of two on said driver mounting board which is 20 to 30 inches by 20 to 30 inches;

said back is partial and provides an exit for the air passage from said drivers wherein the area of said exit is between 100 and 300 square inches;

the distance between said driver mounting board to said back is 4 to 7 inches.

22. The speaker system of claim 11 with a single 15 inch driver wherein said cabinet includes a driver mounting board for mounting said driver, sides, top, bottom, and back;

the distance between the driver mounting board and the back is 5 to 8 inches; the distance between the sides is 15 to 24 inches; and the driver mounting board is 15 to 24 inches wide by 15 to 24 inches high;

said back is partial to provide an exit for said air passage.

23. The speaker system of claim 10 wherein said air-filled passage, neglecting the expanded area of any bends in said air passage, is approximately contant.

24. The speaker system of claim 10 wherein said driver resonant frequency is more than 30 percent less than said free-air low-frequency resonant frequency.

25. The speaker system of claim 18 wherein said air passage begins near the bottom front of said cabinet, extends vertically upward, turns horizontally towards the rear of the cabinet, turns downward, and exits through the bottom of said cabinet near the rear.

26. A combination amplifier and speaker system for converting signals from said amplifier including one or more drivers connected to said amplifier for producing acoustic signals, said drivers having a free-air low-frequency resonance that has a free-air low-frequency resonant frequency;

a cabinet for mounting said driver or drivers and containing an air-filled air passage from a driver to an air passage exit;

wherein said amplifier is mounted to the exterior of said air passage;

wherein the cross sectional area at any point of said passage is between ½ and ⅔ of the total active area of said driver or drivers from the beginning of said passage to said point and the cross sectional area at said exit is between ½ and 3/2 of the total active area of said driver or all of said drivers;

wherein the length of said air passage is less than ⅛ wavelength in air of said free-air low-frequency resonant frequency;

wherein said air passage begins near the top of said cabinet, extends vertically downward past said amplifier, and then turns horizontally to exit said cabinet; and wherein said air passage loads said driver or drivers to produce a resonant frequency lower than said free-air resonant frequency by more than 20 percent.

27. A combination amplifier and speaker system of claim 26 wherein said air passage loads said driver or drivers to reduce the driver resonant frequency by more than 30 percent from said free-air resonant frequency.

28. The combination amplifier and speaker system of claim 26 wherein at least one of said drivers has input terminals for connecting to said amplifier, a voice coil connected to said input terminals and a permanent magnetic structure having a permanent magnet operable over the operating range of said driver including:

a field winding means connected to said input terminals mechanically separate from said voice coil for altering the magnetic field of said permanent magnetic structure, said field winding being part of or forming a rectifier-less filter having a minus 3 db high frequency roll off greater than 50 Hertz; so that the sound from said driver includes components from the interaction said voice coil and said permanent magnet and the intermodulation distortion components from the interaction of the voice coil and said field winding as energized by said signal means; wherein the sounds produced by said field coil are comparatively less than the sounds produced by said voice coil.

29. The combination amplifier and speaker system of claim 26 wherein said amplifier employs a spring reverberation means and said system also includes sheltering means providing a shelter for said reverberation means.

30. The speaker system of claim 10 including amplifier means for driving at least one of said drivers and filter means connected in series with said amplifier means and driver means wherein said filter means attenuates signals to the driver at and near the resonant frequency of said driver more than a higher frequency signal.

31. The combination amplifier and speaker system of claim 26 wherein said amplifier is for the amplification of a musical instrument and said musical instrument has a frequency range, wherein said lowered driver resonant frequency is below said frequency range.

* * * * *